US005628695A

United States Patent [19]

Worthington et al.

[11] Patent Number: 5,628,695

[45] Date of Patent: May 13, 1997

[54] GOLF SWING AND PUTTING TRAINER DEVICE

[76] Inventors: Bradley Worthington, 500 Algonquin Rd., Fairfield, Conn. 06432; Benedict Y. Park, 6100 Post Rd., North Kingstown, R.I. 02852

[21] Appl. No.: 671,047

[22] Filed: Jun. 25, 1996

[51] Int. Cl.[6] ..... A63B 69/36

[52] U.S. Cl. ..... 473/229; 482/123; 473/258

[58] Field of Search ..... 473/229, 258; 482/123

[56] References Cited

U.S. PATENT DOCUMENTS 3,083,016 3/1963 Sumegi ..... 473/229

4,353,556 10/1982 Self et al. ..... 473/229

5,013,045 5/1991 Elmore ..... 473/229

*Primary Examiner*—George J. Marlo

*Attorney, Agent, or Firm*—Henderson & Sturm

[57] ABSTRACT

A golf swing and putting trainer device 10 for use with a variety of golf clubs 100 including woods and irons 101, as well as putters 102. The device 10 comprises a resistance unit 12 operatively connected on one end to anchor elements 23, 24 disposed at spaced locations on a base member 20 and operatively connected on the other end to the upper end of a wood or iron 101 and the intermediate portion of a putter 102 for providing progressive resistance during both an full swing and putting stroke.

11 Claims, 4 Drawing Sheets

GOLF SWING AND PUTTING TRAINER DEVICE

TECHNICAL FIELD

The present invention relates to the field of golf practice devices in general, and in particular to a device that allows the golfer to practice both their full swing and putting strokes.

BACKGROUND ART

As can be seen by reference to the following U.S. Pat. Nos. 5,013,045; 5,022,656; 5,158,299; and 5,478,078; the prior art is replete with myriad and diverse golf swing practice devices and putting practice devices.

While all of the aforementioned prior art constructions are more than adequate for the basic purpose and function for which they have been specifically designed, none of these patented arrangements combines a single practice device that can be used to practice both a full swing and a putting stroke.

As all golfers are acutely aware, a full golf swing and a putting stroke are as different as night and day and involve entirely different sets of muscles, body posture and control. While different training devices are specifically designed for each type of stroke, to date no one has developed a single device that can be employed to practice both type of golf strokes.

As a consequence of the foregoing situation, there has existed a longstanding need among golfers for a new type of training device that employs means for offering progressive resistance on both the backswing and release portions of both a full swing motion and a putting motion to not only strengthen the muscles involved in each portion of the stroke, but also to improve muscle memory so that the stroke can be repeated effortlessly on the golf course; and, the provision of such a construction is a stated objective of the present invention.

DISCLOSURE OF THE INVENTION

Briefly stated, the golf swing and putting trainer device that forms the basis of the present invention comprises in general a base unit provided with a resilient resistance unit that may be selectively positioned both on the base unit and relative to different portions of a variety of golf clubs, or the like, to permit the golfer to practice either a full swing, a short chip, or a putting stroke.

As will be explained in greater detail further on in the specification, the very nature of the two different types of golf swings require that the point of application of the resistance forces necessary to produce the desired results must originate from different locations due to the different body movement associated with each type of stroke.

In addition, the point of attachment of the resistance unit relative to the different types of golf clubs will vary depending on whether the club is to be normally used from the tee box or fairway, versus on or near the green and this invention accommodates both situations.

As will also be explained further on in the specification, the base unit is also provided with a guide rail element which cooperates with the resistance unit to force the golfer to make straight putting strokes against progressive resistance on both the backswing and follow through to imprint the proper stroke in their muscle memory.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
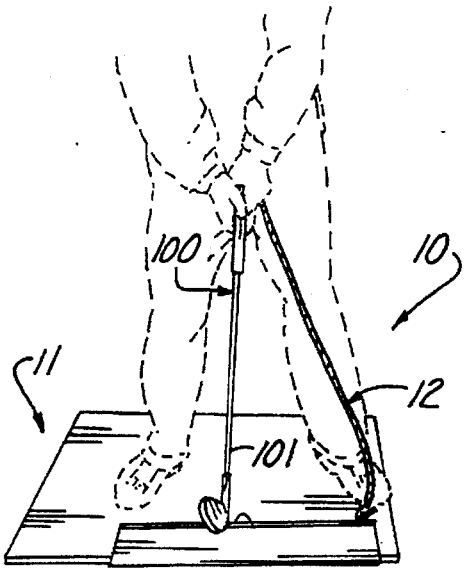
FIG. 1 is a front perspective view of the golf swing and putting training device that forms the basis of the present invention with the golfer addressing the ball prior to a full swing.
Figure 3:
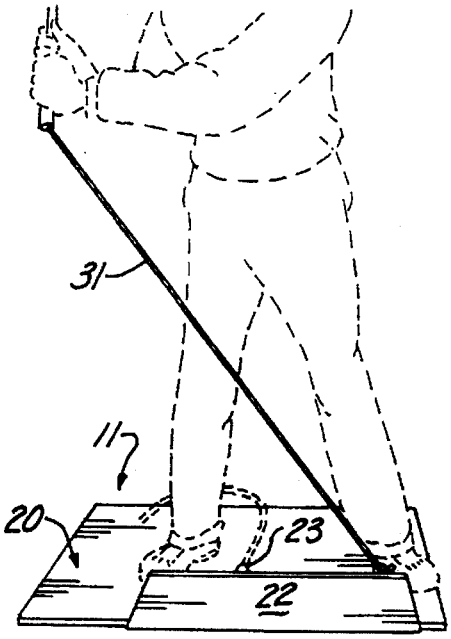
FIG. 3 is a front perspective view of the device showing the golfer near the top of the backswing.
Figure 2:
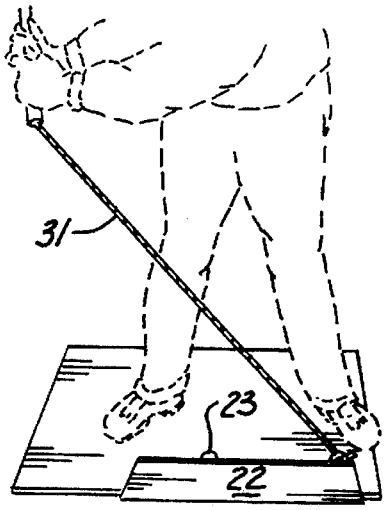
FIG. 2 is a front perspective view of the device showing the golfer during the initial backswing phase of a full swing.
Figure 4:
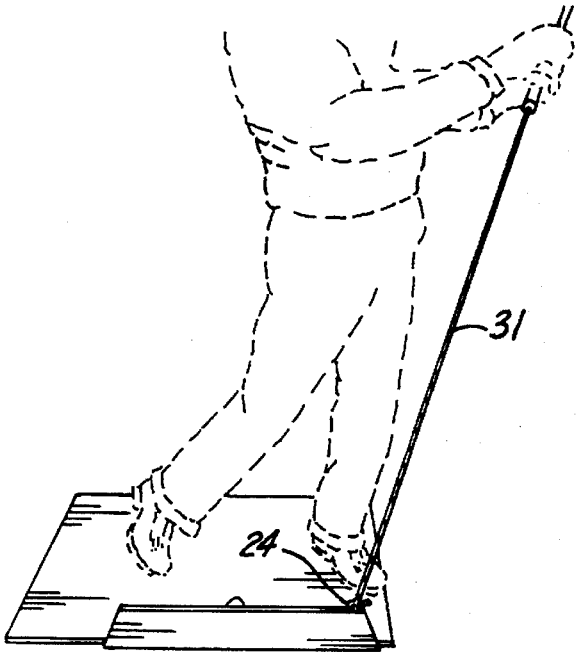
FIG. 4 is a front perspective view of the device showing the golfer during the follow thru phase of the swing.

As can be seen by reference to the drawings, and in particular to FIG. 1, the golf swing and putting training device that forms the basis of the present invention is designated generally by the reference numeral 10. The training device 10 comprises in general, a base unit 11 and a resilient resistance unit 12. The resistance unit 12 is operatively connected to the base unit 11 and adapted to be secured to a variety of different golf clubs 100, including, but not limited to, woods, and/or irons 101, and putters 102 or the like. These units will now be described in seriatim fashion.

As shown in FIGS. 1 through 6, and 9 through 12 the base unit 11 comprises a generally flat elongated rectangular base member 20 dimensioned to accommodate both of the golfers's feet in the golfer's normal swing stance. In addition, the front portion 21 of the base member 20 is provided with a guide track 22 and a plurality of anchor elements 23, 24 spaced from the guide track. One of the anchor elements 23 is disposed intermediate the golfer's stance and the other anchor element 24 is disposed forward of the golfer's stance.

In the preferred embodiment of the invention depicted in FIGS. 1 through 6, the resilient resistance unit 12 comprises a pair of resilient resistance members 30, 31 wherein the shorter of the resistance members 30 is operatively secured on the lower end to the intermediate anchor element 23 and the longer of the resilient resistance members 31 is operatively secured on the lower end to the forward anchor element 24.

Figure 7:
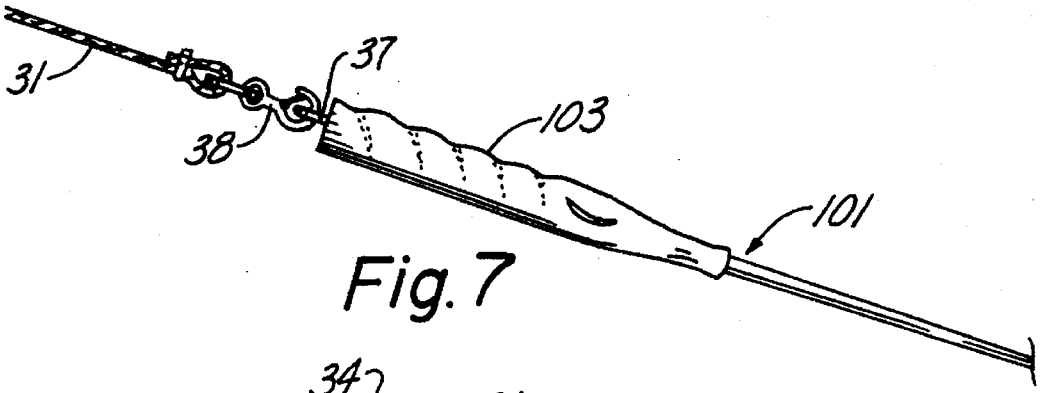
FIG. 7 is an isolated detail view of a securing means adapted to engage the top end of a golf club.

Turning now in particular to FIG. 7, it can be seen that the upper end of the relatively long resistance member 31 is operatively attached to the tops of the handle portion 103 of a full swing club 101 such as a wood or long iron by a ring 37 and clip 38 arrangement. The reason for this particular placement of the attachment between the resistance member 31 and the full swing club 101 is clearly illustrated in FIGS. 2 through 4, wherein the maximum oppositely acting resistances produced by the resistance member 31 occur near the top of the backswing and near the end of the follow through.

Therefore, when the golfer assumes the ball address stance, illustrated in FIG. 1, there is virtually no opposing resistance generated by the resistance member 31. However, as the golfer begins the backswing progressive resistance is generated by the resistance member 31 as the golfer's wrists approach the nine o'clock position. The resistance will diminish slightly as the backswing passes through the nine o'clock position.

Once the golfer reaches the top of their backswing, they will once again encounter a slight increase in resistance as they initiate their downswing until their wrists pass through the nine o'clock position, whereupon the force of the resistance member will accelerate the golf club 101 through the ball impact zone. Then once the impact zone has been traversed, the resistance member 31 will once again offer progressive resistance as the follow through is completed.

It should be noted at this juncture that the elongated resistance member 31 serves many valuable functions during the different phases of a full wing. To begin with, the progressive resistance from the six o'clock position to the nine o'clock position strengthens the back muscles of the golfer and helps to promote the proper pivoting motion of the user's body and the remaining portion of the backswing beyond nine o'clock strengthens the golfer's wrist and forearm muscles. As the golfer begins the downswing phase, the resistance of the member 31 consciously forces the golfer to fully extend their arms in the proper orientation as their wrists pass through the nine o'clock position.

Once the golfer's wrists pass through the nine o'clock position, the resistance member 31 accelerates the speed of the downswing through the ball impact zone, and simultaneously causes the golfer to reverse pivot. Then after the golf swing passes through the impact zone, the resistance member 31 once again exerts a progressive resistance as the golfer finishes the follow through phase of the stroke.

This last feature is particularly important in teaching those golfers who slap at the ball to swing through the ball. This is because when the golfer slaps at the ball the resistance member 31 will not exert any resistance at the end of the slap stroke. However, resistance will be applied by resistance member 31 during the follow through stroke of a golfer who has swung through the ball.

Figure 5:
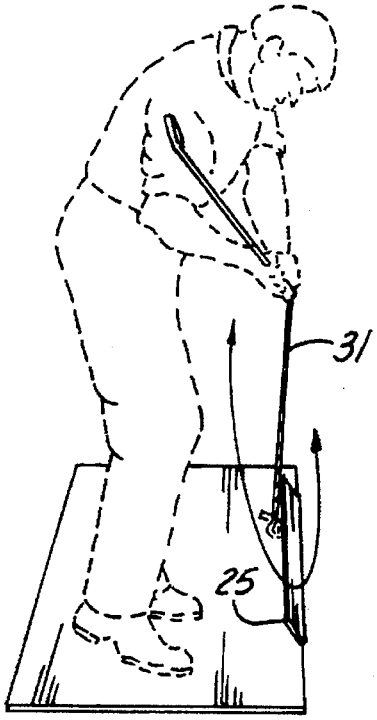
FIG. 5 is a side perspective view showing the golfer in mid-swing.
Figure 6:
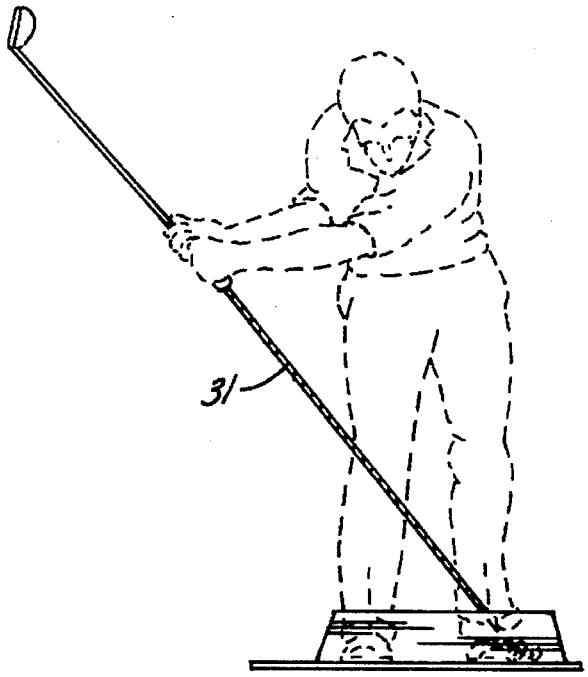
FIG. 6 is a from perspective view showing the golfer in mid-swing.
Figure 9:
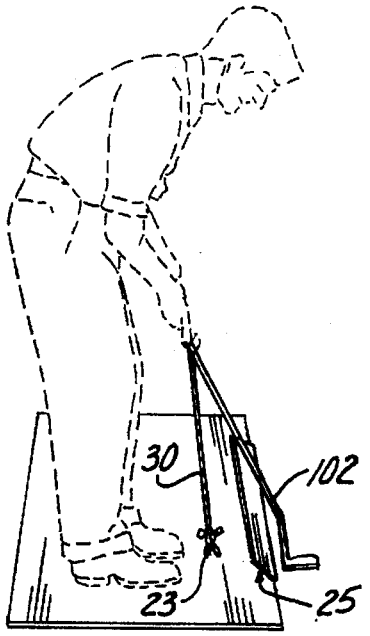
FIG. 9 is a side perspective view of the device employed with a putter.
Figure 10:
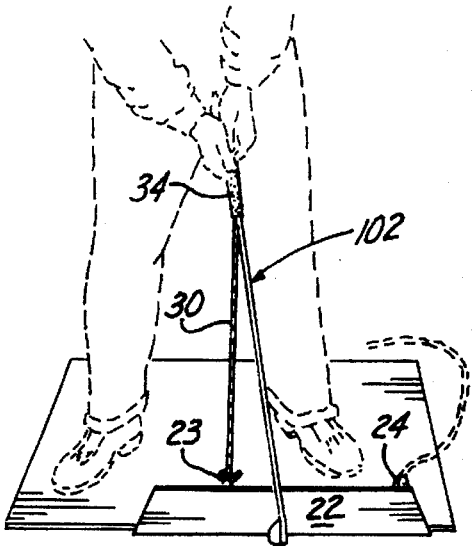
FIG. 10 is a from perspective view of the device showing the golfer addressing a putt.

Turning now to FIGS. 5 and 9, it can be seen that both of the anchor elements 23, 24 are disposed in a generally parallel alignment with the guide track 22. The guide track 22 includes an angled panel 25 which is disposed at an angle of less than 90° relative to the top surface of the base member 20 for reasons that will be explained presently.

As shown in FIGS. 8 through 12, the lower end of the relatively short resilient resistance member 30 is attached to the intermediate anchor element 23 whereas the upper end of the resistance member 30 is provided with an attachment member 34 which encircles and captively engages the intermediate portion of any golf club 100.

Figure 8:
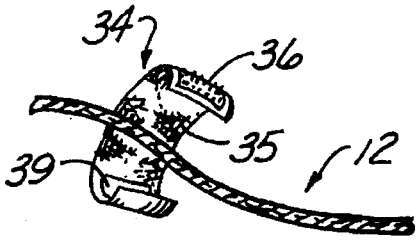
FIG. 8 is an isolated detail view of a securing means adapted to engage the intermediate portion of a golf club.

In one version of the preferred embodiment depicted in FIG. 8, the attachment member 34 comprises a constrictable sleeve element 35 dimensioned to loosely receive the handle of any golf club 100 in the relaxed mode, yet to captively engage the intermediate portion of the golf club when the sleeve element 35 is constricted.

In the preferred embodiment depicted in FIG. 8, the encircling attachment member 34 comprises a pair of hook and loop fasteners 36 and 39 which are dimensioned to encircle and captively engage the intermediate portion of a putter 102 or the like, which requires a relatively short golf stroke.

Referring to FIGS. 9 through 12, it can be seen that the relatively short resistance member 30 is secured to the putter 102 by the attachment member 34 proximate the juncture of the hand grips with the putter shaft. Furthermore, the length of the resistance member 30 is chose such that the resistance member 30 will offer very little if any, resistance to the putter 102 in the ball address position illustrated in FIGS. 9 and 10.

Figure 11:
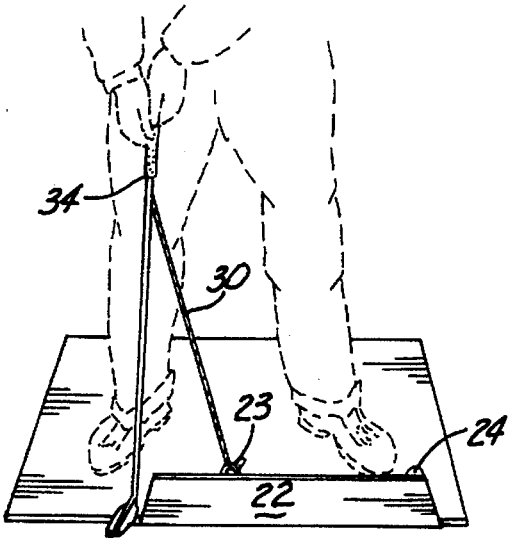
FIG. 11 is a front perspective view of the device showing the golfer during the take back portion of the putting stroke.
Figure 12:
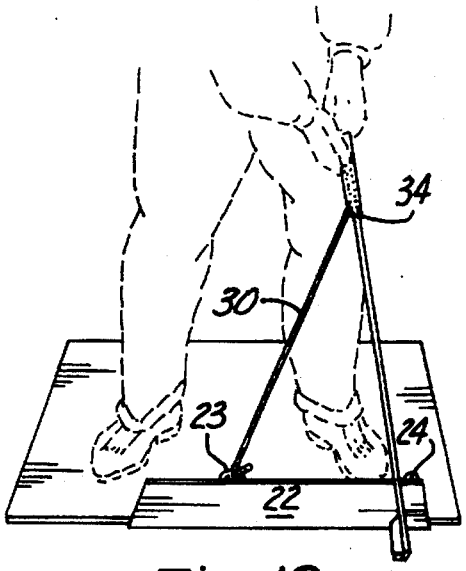
FIG. 12 is a front perspective view showing the golfer during the follow thru portion of the putting stroke; and, FIG. 13 is an isolated detail view of an integrated resistance unit.

However, as shown in FIGS. 11 and 12, the resistance member 30 offers equal and opposite acting progressive resistance on both the take back and follow through phases of the putting stroke. In theory, the length of the take back and follow through phases of a putting stroke should be the same. The equal and opposite reaction of the resistance member 30 offers an excellent means of enhancing both the golfer's muscle memory and control, while also emphasizing the need for the golfer to strike through the ball.

It should also be noted at this juncture that the equal and opposite resistance force of resistance member 30 is quite a bit different than the resistance offered by resistance member 31 in that in the latter instance, the major resistance is applied during the backswing and the initial downswing phases of the full swing wherein all of the power is generated.

As can also be appreciated by reference to FIGS. 9 through 12, the angled panel 25 serves to guide the putter head in a straight line during both the take back and follow through phases of the putting stoke and teaches and encourages the golfer to duplicate that straight line stroke when on a green.

Figure 13:
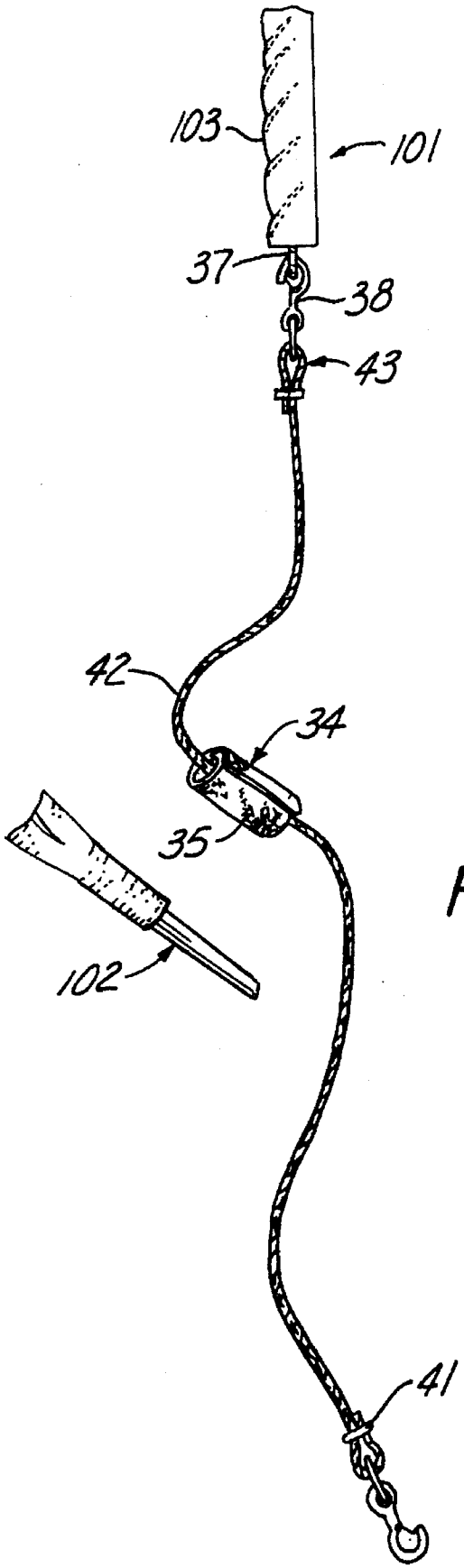

Up to this point, the description of the preferred embodiment of this invention has called for the resistance unit 12 to comprise a pair of resistance members 30 and 31. However, in an alternate version of the preferred embodiment illustrated in FIG. 13, it can be seen that the resistance unit 12 may also comprise a single resilient resistance member 40 having a lower end 41 which is releasably secured to either one of the pair of anchor elements 23, 24, an intermediate portion 42 which may optionally be attached to the intermediate portion of a golf club via the previously described encircling attachment member 34 and an upper end 43 which may optionally be attached to the upper end of a golf club via a conventional ring 37 and clasp 38 arrangement.

Having thereby described the subject matter of the present invention, it should be apparent that many substitutions, modifications and variations of the present invention are possible in light of the above teachings. It is therefore to be understood that the invention as taught and described herein is only to be limited to the extent of the breadth and scope of the appended claims.

We claim:

1. A golf swing and putting trainer device for use in combination with a plurality of golf clubs including but not limited to woods, irons, practice clubs and putters wherein the training device comprises:

an enlarged generally flat base member;

a pair of anchor elements disposed at spaced locations on said base member;

an elongated resilient resistance member having an upper end, a lower end selectively attached to one of said pair of anchor elements, and an intermediate portion;

first attachment means associated with said upper end of the resistance member for connecting the upper end of the resistance member to the upper end of selected ones of said plurality of golf clubs; and second attachment means associated with the intermediate portion of the resistance member for connecting the intermediate portion of the resistance member to the intermediate portion of selected ones of said plurality of golf clubs.

2. The trainer device as in claim 1 wherein the resistance force produced by said resistance member will vary depending on the particular anchor element and the particular attachment means selected.

3. The trainer device as in claim 1 wherein the first attachment means comprises: a ring and clip arrangement wherein a selected portion of the ring and clip arrangement is operatively secured to the upper end of the resistance member and the other portion of the ring and clip arrangement is operatively secured to the upper end of the selected one of said plurality of golf clubs.

4. The trainer device as in claim 3 wherein the second attachment means comprises: an encircling attachment member dimensioned to captively surround the intermediate portion of the plurality of golf clubs.

5. The trainer device as in claim 4 wherein said encircling attachment member comprises a constrictable sleeve element dimensioned to slidably receive the upper portion of any golf club handle in the relaxed mode and adapted to captively engage the intermediate portion of any one of the plurality of golf clubs in the constricted mode.

6. The trainer device as in claim 4 wherein said encircling attachment member comprises a pair of hook and loop fastening elements which are dimensioned to surround and captively engage the intermediate portion of any one of the plurality of golf clubs.

7. A golf swing and putting trainer device for use in combination with a plurality of golf clubs including but not limited to woods, irons, practice clubs and putters wherein the training device comprises:

an enlarged generally flat base member;

a pair of anchor elements disposed at spaced locations on said base member;

a first generally elongated resistance member having an upper end adapted to be attached to the upper end of selected ones of said plurality of golf clubs; and a second relatively short resistance member having an upper end adapted to be attached to an intermediate portion of selected ones of said plurality of golf clubs.

8. The trainer device as in claim 1 or 7 wherein said base member has a generally rectangular configuration, wherein one of said anchor elements is disposed adjacent to, but spaced from, one edge of the base member; and wherein the other of said anchor elements is disposed adjacent to, but spaced from, the intermediate portion of an adjacent edge of the base member.

9. The trainer device as in claim 8 wherein said anchor elements are generally aligned relative to said adjacent edge.

10. The trainer device as in claim 9 wherein the base member is further provided with a guide track along said adjacent edge.

11. The trainer device as in claim 10 wherein said guide track includes a panel that is disposed at an angle of less than 90° relative to the base member.

* * * * *